US005128637A

United States Patent [19]

Nisbet et al.

[11] Patent Number: 5,128,637

[45] Date of Patent: Jul. 7, 1992

[54] RADIO SIGNAL POLARIZATION SWITCHING ARRANGEMENT

[75] Inventors: William T. Nisbet; Andrew P. Baird, both of Bo'ness, Scotland

[73] Assignee: Racal-Mesl Limited, Midlothian, Scotland

[21] Appl. No.: 649,572

[22] Filed: Feb. 1, 1991

[30] Foreign Application Priority Data

Feb. 2, 1990 [GB] United Kingdom ..... 9002366

[51] Int. Cl.[5] ..... H01P 1/175

[52] U.S. Cl. ..... 333/24.3; 333/21 A; 343/756; 343/786

[58] Field of Search ..... 333/21 A, 24.3; 343/756, 786

[56] References Cited

U.S. PATENT DOCUMENTS 2,857,575 10/1958 Zaleski .
2,863,144 12/1958 Herscovici et al. ..... 333/24.3 X
2,908,878 10/1959 Sullivan et al. ..... 333/24.3 X
2,909,738 10/1959 Davis et al. ..... 333/24.3
3,084,295 4/1963 Rosen ..... 333/24.3 X
3,130,379 4/1964 Hadley .
4,498,061 2/1985 Mörz ..... 333/21 A
4,821,002 4/1989 Luly ..... 333/24.3 X

FOREIGN PATENT DOCUMENTS 0059927 9/1982 European Pat. Off. .
1085934 7/1960 Fed. Rep. of Germany .
1166402 10/1969 United Kingdom .

*Primary Examiner*—Paul Gensler
*Attorney, Agent, or Firm*—Leydig, Voit & Mayer

[57] ABSTRACT

A radio signal polarization switching arrangement is responsive to linearly polarized radio signals, such as television signals from a satellite. The switching arrangement which is capable of selecting signals having either one of predetermined states of linear polarization comprises a dielectric support block which supports a ferrite rod axially in a circular waveguide. A metal or metallized layer is deposited on an external surface of the support block and an energizing coil is wound around the layer in axial alignment with the rod. The support block has a stepped configuration at opposite ends in order to compensate for the loading effect of the ferrite rod on the waveguide.

14 Claims, 2 Drawing Sheets

RADIO SIGNAL POLARIZATION SWITCHING ARRANGEMENT

BACKGROUND OF THE INVENTION

The invention relates to arrangements responsive to polarised radio signals such as radio transmissions from satellites such as television transmissions.

In order to maximize bandwidth utilization, signals transmitted via a satellite may be transmitted with more than one sense of polarization; for example, signals representing one television channel may be transmitted (at a particular frequency) with one mode of linear polarisation, say, horizontal polarization, whereas signals representing another television channel may be transmitted at the same or a near by frequency but with (in this example) vertical polarisation. Similarly, the two senses of circular polarisation can be used, respectively, instead of the two modes of linear polarisation. In order for an antenna to be set to receive signals representing a particular television channel, it is therefore necessary for the antenna to be switchable into a state in which it can receive signals having the corresponding polarisation state.

SUMMARY OF THE INVENTION

According to the invention, there is provided a polarisation switching arrangement responsive to polarised radio signals and capable of selecting signals having either one of predetermined states of linear polarisation, comprising a dielectric support block supporting a ferrite rod on a longitudinal axis of the block, a metal or metallised layer disposed on an external surface of the block around the ferrite rod, in axial alignment therewith, and an electrical coil wound around said layer also in axial alignment with the ferrite rod wherein the metal or metallized layer constitutes a waveguide for said polarised radio signals, said electrical coil is selectively energisable to generate a magnetic field in one axial direction along the ferrite rod, whereby to select one said predetermined state of linear polarisation or in the opposite axial direction along the ferrite rod, whereby to select the other of said predetermined states of linear polarisation, orthogonal to said one predetermined state of linear. Polarisation, and opposite axial ends of the support block are so shaped as to compensate for the loading effect of the ferrite rod.

According to a further aspect of the invention there is provided a polarisation switching arrangement responsive to polarised radio signals and capable of selecting signals having either one of predetermined states of linear polarisation, comprising a waveguide body, a dielectric support block axially supporting a ferrite rod within the waveguide body, a metal or metallised layer disposed on an external surface of the support block around the ferrite rod in axial alignment therewith and an electrical coil wound around said layer also in axial alignment with the ferrite rod, wherein the metal or metallised layer constitutes a waveguide for said polarised radio signals, said electrical coil is selectively energisable to generate a magnetic field in one axial direction along the ferrite rod whereby to select one said predetermined state of linear polarisation or in the opposite axial direction along the ferrite rod whereby to select the other said predetermined state of linear polarisation, and opposite axial ends of the support block are so shaped as to compensate for the loading effect of the ferrite rod on the waveguide body.

A polarisation switching arrangement in accordance with the invention is less frequency dispersive than hithertoknown arrangements; that is, it is possible to accomplish the required switching over a desired frequency range using a single energisation level and a relatively short ferrite rod.

The switching arrangement also has a compact structure and can be assembled in a convenient, straightforward manner using assembly procedures conducive to mass production.

In this specification and its claims, the term "ferrite" includes any other material achieving the same effect as ferrite within the context of the arrangements and methods referred to.

DESCRIPTION OF THE DRAWINGS

A polarisation switching arrangement embodying the invention is now described, by way of example only, with reference to the accompanying drawings, in which.

DESCRIPTION OF PREFERRED EMBODIMENTS

Figure 1:
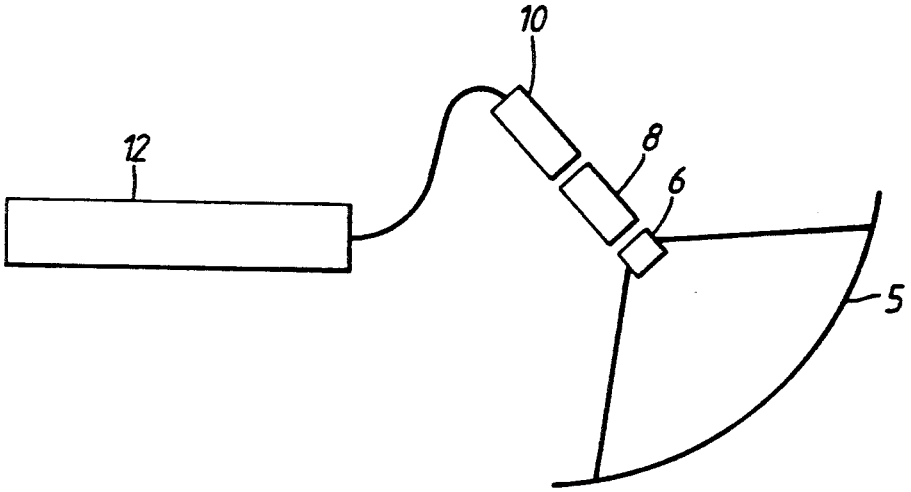
FIG. 1 shows an antenna arrangement incorporating a polarisation switching arrangement in accordance with the present invention.

As shown in FIG. 1, the antenna arrangement comprises a parabolic dish antenna 5 focussing the received signals onto a suitable feedhorn 6. Such signals are those transmitted or transported by a satellite and may be horizontally or vertically polarised; both horizontally and vertically polarised signals will be received by the dish at the same time.

The feedhorn 6 collects the signals and propagates them into a circular waveguide (not shown) which feeds them to a polarisation switching arrangement 8. In a manner to be described in more detail below, the polarisation switching arrangement 8 can be set into either of two states in which it respectively selects the horizontally and the vertically polarised signals. The selected signals will lie in any frequency channel (within the total bandwidth used), and with the selected plane of polarisation. These signals are passed to a low noise block down-converter 10 which selects the particular frequency channel and converts the signals into suitable form for transmission to a receiver 12 from where they are passed to the conventional television set.

Figure 2:
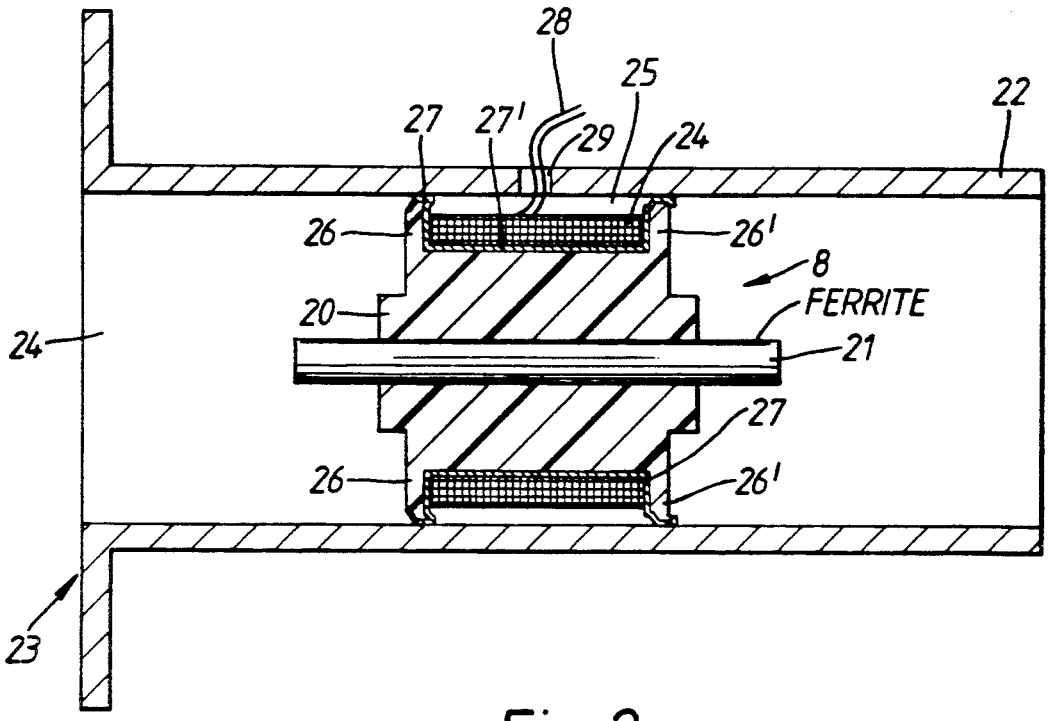
FIG. 2 shows a cross-sectional view through the polarisation switching arrangement press-fitted in a waveguide body.
Figure 3:
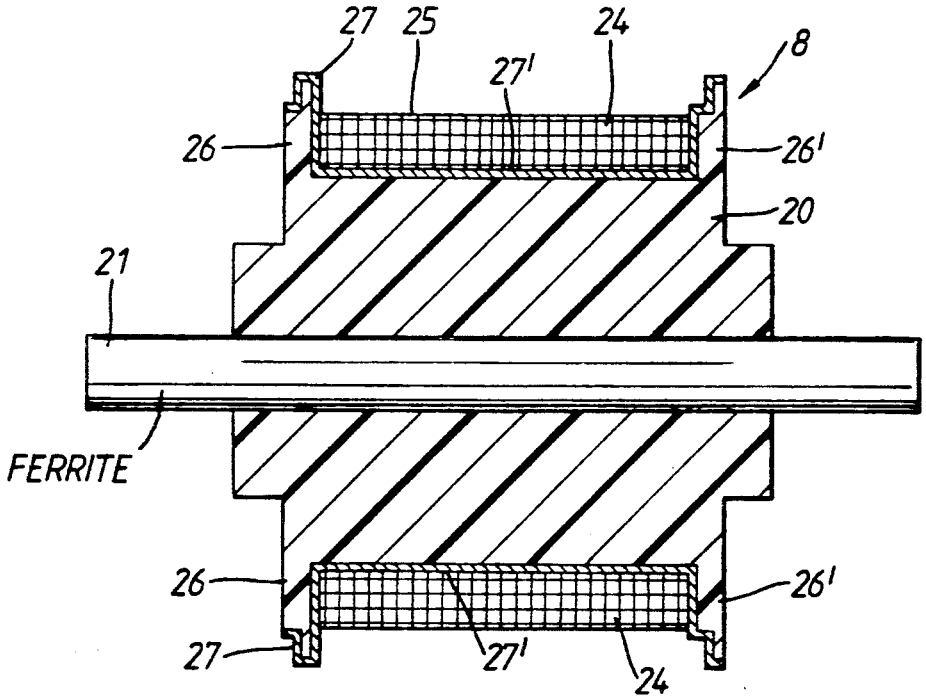
FIG. 3 is an enlarged, cross-sectional view through the polarisation switching arrangement.

The polarisation switching arrangement 8 is shown in more detail in FIGS. 2 and 3.

As shown in FIG. 2, it comprises a dielectric block 20 supporting a ferrite rod 21 axially within a circular waveguide body 22.

At the input end, the circular waveguide body receives linearly polarised signals from the feedhorn 6, shown in FIG. 1. The feedhorn could be an integral part of the waveguide body.

In this embodiment, in order to feed the output from the polarisation switching arrangement to the low noise block 10, a rectangular waveguide is connected at end 23. To that end, the circular waveguide body includes a shaped portion 24 providing a suitable transition between the circular cross-section of the waveguide body 22 and the rectangular cross-section waveguide connected to end 23.

The dielectric block 20 is made from a low dielectric constant material such as a plastic material (e.g. polypropylene) and is preferably formed by injection moulding.

The block 20 also serves as a former for an electrical energising coil 24 and, to that end, is shaped as a bobbin having a shallow, circumferential recess 25 bounded by a respective wall 26,26' at each end of the block.

The outer periphery of each end wall 26,26' is of reduced thickness, as seen best in FIG. 3, and is thereby rendered sufficiently pliable as to be capable of being folded over, enabling block 20 to be press-fitted into the waveguide body 22, as shown in FIG. 2.

External surfaces of block 20 are provided with a metal or metallised layer 27 of which a central section 27' is in axial alignment with the ferrite rod 21 and constitutes a waveguide for the received, linearly polarised radio signals. In this particular embodiment, layer 27 is of aluminium and is deposited on the dielectric block by vacuum plating, and the layer has a sufficient thickness so as to minimise insertion losses.

A film of laquer may be applied above and below the aluminium layer in order to assist adhesion of, and provide protection for, the layer.

Layer 27 extends over the inwardly facing, and the outer edge surfaces of the end walls so as to ensure electrical continuity between the central section 27' of the layer and the circular waveguide body 22. Thus, in effect, the circular waveguide body and the central section 27' define a continuous waveguide for the received, linearly polarised signals.

The energising coil 24 is wound around the central section 27' of layer 27 to be in axial alignment with the ferrite rod 21 and is effective, when supplied with electrical current, to generate a magnetic field in an axial direction along the rod. Lead wires 28 for the coil are connected to a suitable current source (not shown) via an aperture 29 in the surrounding waveguide body.

In order to compensate for the loading effect of the ferrite rod on the waveguide the dielectric block is formed with a stepped configuration at each end. This arrangement is particularly advantageous in that it is relatively easy to manufacture and obviates the need to taper the ends of the ferrite rod, which involves an expensive machining operation. Thus, the ferrite rod has a uniform, circular cross-section along its length and has flat end faces which are normal to the longitudinal axis of the rod. The central bore of the dielectric block is suitably configured to enable the rod to be press-fitted therein. In this example, the bore- is square in cross-section.

As indicated above, the purpose of the polarisation switching arrangement 8 is to select either horizontally or vertically polarised signals from the received signals.

The polarisation switching arrangement 8 operates using Faraday rotation. Its switching action is achieved by reversing the direction of the magnetic field applied axially along the ferrite rod 21. Thus, in order to select signals in one of the two planes of polarisation, the energising coil winding 24 is energised with current of one polarity and of such magnitude as to rotate the plane of polarisation by 45° in one angular direction relative to the datum position of the plane of polarisation, that is, the position of the plane of polarisation with zero current. In this way, the polarisation switching arrangement 8 is set into one of its two settings and (according to the physical orientation of the arrangement) selects either the horizontally or vertically polarised signals. In order to switch the polarisation switch into its opposite setting, to select the other polarised signals, the current in the coil 24 is altered so as to have the same magnitude as previously but in the opposite direction. The plane of polarisation is now rotated through the datum angular position (obtaining with zero current) and thence to a position at 45° on the other side of the datum position.

As compared with an arrangement in which the plane of polarisation is switched between zero and +90°, the arrangement described, in which the plane of polarisation is switched from +45° to −45°, is advantageous in that the length of the ferrite rod 21 is halved (alternatively, the length of the ferrite rod can be the same as with an arrangement where the plane of polarisation is switched between 0° and 90° and the current can instead be halved). In addition, the reduced rotation (the maximum rotation is 45° from the datum setting) is less frequency-dispersive; that is, a single current level is sufficient to obtain the required rotation over the complete frequency range. The reduced-length ferrite rod allows a lower insertion loss and this improves the noise performance of the system.

It will be appreciated that these advantages can be achieved not only with a polarisation switching arrangement in which switching occurs between +45° and −45°, but also with other arrangements in which the plane of polarisation is switched between zero and 90°.

Since the energising coil occupies recess 25 in the dielectric block 20 it is located externally of the waveguide defined by section 27' of layer 27, and yet is entirely within the waveguide body 22. Accordingly, this arrangement is compact and is relatively easy to assemble, being well suited to mass production techniques.

In particular, the dielectric block (bearing layer 27), the ferrite rod 21 and the energising coil 24 may be assembled as an integral unit. The unit may then simply be press-fitted into a suitable waveguide body either "in-house", as a further step in the assembly procedure or later, by an end-user.

Moreover, since the support block is designed with "fold-over" portions it can be press-fitted into a waveguide body having a range of different bore sizes. Thus, the tolerances within which the support body and/or the waveguide need to be manufactured are less exacting.

The polarisation switching arrangement described with reference to FIGS. 2 and 3 is for use in selecting either of the linearly polarised signals. As explained above, however, signals may be received with circular polarisation, that is, circularly polarised in either sense. In order to enable circularly polarised signals to be selected a polariser having the form shown in block diagram configuration in FIG. 4 may be used.

Figure 4:
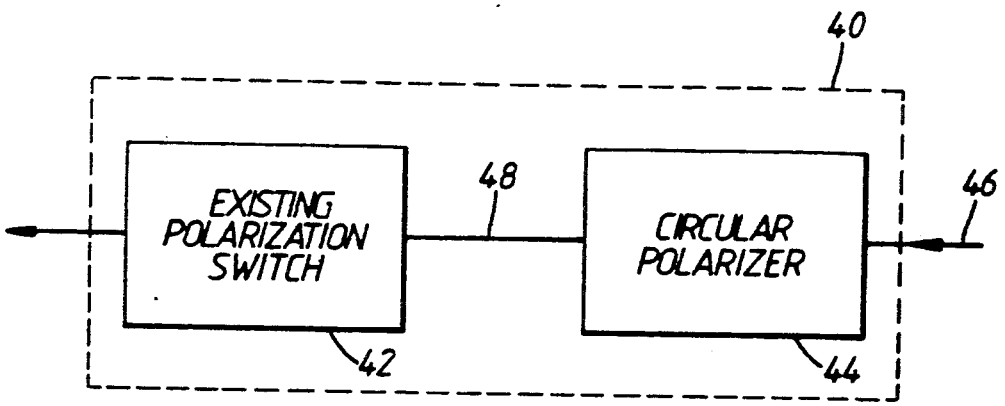
FIG. 4 is a block diagram of a modified form of the polarisation switching arrangement for use when linearly and circularly polarised signals may be received.

The polarising switching arrangement 40 shown in FIG. 4 comprises a polarisation switching arrangement 42 in accordance with the invention for selecting horizontally or vertically polarised signals and which may take the form shown in FIGS. 2 and 3 for example. The polarisation switching arrangement 42 is connected in series with a circular polariser 44. Circular polariser 44 comprises a polariser which converts circular polarisation to linear polarisation. The circular polariser 44 may be of the quarter-wave dielectric plate type, for example. This operates by converting one sense of circular polarisation into one form of linear polarisation and the other sense of circular polarisation into the orthogonal linear polarisation. Incoming signals from the antenna are received on a line 46. Therefore, if such signals are circularly polarised in both senses, the circular polariser 44 will produce, on an output line 48, correspondingly linearly polarised signals, that is, with both horizontal and vertical polarisation. Signals with one of these senses of linear polarisation are selected by the polarisation switch 42 in the manner already described, and are then passed to the low noise block 10 in the manner already explained (see FIG. 1). Any other suitable type of circular polariser can be used instead, such as a corrugated waveguide or a waveguide with a suitably stepped internal configuration.

The circular polariser 44 is arranged (such as by appropriate alignment of its quarter wave plate) such that an incoming horizontally or vertically polarised signal is phase-shifted; its polarisation is not changed.

We claim:

1. A polarisation switching arrangement responsive to polarised radio signals ad capable of selecting signals having either one of predetermined states of linear polarisation, comprising a dielectric support block supporting a ferrite rod on a longitudinal axis of the block, a metal or metallised layer disposed on an external surface of the block around the ferrite rod, in axial alignment therewith, and an electrical coil wound around said layer, also in axial alignment with the ferrite rod wherein the metal or metallised layer constitutes a waveguide for said polarised radio signals, said electrical coil is selectively energisable to generate a magnetic field in one axial direction along the ferrite rod, whereby to select one said predetermined state of linear polarisation or in the opposite axial direction along the ferrite rod, whereby to select the other of said predetermined states of linear polarisation, orthogonal to said one predetermined state of linear polarisation, and opposite axial ends of the support block are so shaped as to compensate for the loading effect of the ferrite rod, and the dielectric support block has a circumferential recess bounded by a respective wall at each end of the block, said metal or metallised layer is disposed on a surface of the recess, and the electrical coil, wound around the layer, is contained within the recess.

2. An arrangement as claimed in claim 1, wherein the outer periphery of each end wall is made pliable enabling the support block to be press-fitted into a waveguide body of corresponding internal cross-sectional size.

3. An arrangement as claimed in claim 2, wherein surfaces of the end walls also have a metal or metallised layer whereby to provide electrical continuity between the layer around which the electrical coil is wound and a waveguide body into which the support block is press-fitted.

4. An arrangement as claimed in claim 1, wherein the support block is made of a plastic material.

5. An arrangement as claimed in claim 4, wherein the plastic material is polypropylene.

6. An arrangement as claimed in claim 1, wherein the opposite axial ends of the support block have a stepped configuration.

7. An arrangement as claimed in claim 1, wherein the ferrite rod has flat end faces which are normal to the longitudinal axis of the rod.

8. An arrangement as claimed in claim 1, wherein the support block is arranged to be press-fitted into a waveguide body of corresponding internal cross-sectional size.

9. An arrangement as claimed in claim 1, including energisation means for controlling energisation of the electrical coil.

10. A polarisation switching arrangement responsive to polarised radio signals and capable of selecting signals having either one of predetermined states of linear polarisation comprising a waveguide body, a dielectric support block axially supporting a ferrite rod within the waveguide body, a metal or metallised layer disposed on an external surface of the support block around the ferrite rod, in axial alignment therewith, and an electrical coil wound around said layer also in axial alignment with the ferrite rod, wherein the metal or metallised layer constitutes a waveguide for said polarised radio signals, said electrical coil is selectively energisable to generate a magnetic field in one axial direction along the ferrite rod whereby to select one said predetermined state of linear polarisation or in the opposite axial direction along the ferrite rod whereby to select the other said predetermined state of-linear polarisation orthogonal to said one predetermined state of linear polarisation, and opposite axial ends of the support block are so shaped as to compensate for the loading effect of the ferrite rod on the waveguide body.

11. An arrangement as claimed in claim 10, wherein the dielectric support block is arranged to be press-fitted into the waveguide body.

12. An arrangement as claimed in claim 10, wherein the waveguide body is circular in cross-section and incorporates, at its output end, an integral circular-to-rectangular waveguide transducer for connection to a rectangular waveguide.

13. An arrangement as claimed in claim 10, including, at the input end of the waveguide body, a feedhorn for receiving polarised radio signals.

14. An arrangement as claimed in claim 13, in which the feedhorn is integral with the waveguide body.

* * * * *